US006677537B2

(12) United States Patent
Kawanami

(10) Patent No.: US 6,677,537 B2
(45) Date of Patent: Jan. 13, 2004

(54) NONRECIPROCAL CIRCUIT DEVICE AND MOUNTING STRUCTURE OF THE SAME

(75) Inventor: Takashi Kawanami, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 247 days.

(21) Appl. No.: 09/897,507

(22) Filed: Jun. 29, 2001

(65) Prior Publication Data

US 2002/0014926 A1 Feb. 7, 2002

(30) Foreign Application Priority Data

Jun. 30, 2000 (JP) ..... 2000-197656

(51) Int. Cl.[7] ..... H05K 1/16
(52) U.S. Cl. ..... 174/260; 174/261
(58) Field of Search ..... 174/260, 261; 361/767–776

(56) References Cited

U.S. PATENT DOCUMENTS 5,490,040 A * 2/1996 Gaudenzi et al. ..... 174/260
5,523,622 A * 6/1996 Harada et al. ..... 174/259
6,134,118 A * 10/2000 Pedersen et al. ..... 174/255
6,350,954 B1 * 2/2002 Specks et al. ..... 122/178

FOREIGN PATENT DOCUMENTS

| | | |
|---|---|---|
| EP | 1 119 111 | 7/2001 |
| JP | 9-321504 | 12/1997 |
| JP | 11-239009 | 8/1999 |

* cited by examiner

*Primary Examiner*—Albert W. Paladini
*Assistant Examiner*—Jeremy Norris
(74) *Attorney, Agent, or Firm*—Keating & Bennett, LLP

(57) ABSTRACT

In order to suppress losses, unnecessary radiation, and internal mutual interference produced in a connecting portion between a nonreciprocal circuit device and circuits to be connected thereto and to promote reduction in size and weight of the device, a nonreciprocal circuit device and its mounting structure are provided. Output terminals are disposed on a mounting surface (bottom surface) of an isolator and input terminals are disposed at a height higher from the bottom surface as much as the height of a module circuit board. The top surface of the module circuit board is provided with connecting pads for connecting to the input terminals of the isolator. The module circuit board is provided with a shield case which is connected to ground terminals protruding from a yoke of the isolator. A part in which the module circuit board is integrated with the isolator is mounted on a printed circuit board.

22 Claims, 12 Drawing Sheets

NONRECIPROCAL CIRCUIT DEVICE AND MOUNTING STRUCTURE OF THE SAME

BACKGROUND OF THE INVENTION

1. Field of the Invention

The present invention relates to a nonreciprocal circuit device such as an isolator and a circulator used at microwave bands, and relates to a mounting structure of the nonreciprocal circuit device and a communication apparatus having the nonreciprocal circuit device.

2. Description of the Related Art

Hitherto, a concentrated-constant-type isolator, for example, comprises a ferrite assembly having a plate-like ferrite with plural central conductors closely arranged thereto and intersecting with each other, a magnet accommodated in a case for applying a static magnetic field to the ferrite, and input-output terminals exposed or protruded outside the case.

FIGS. 13A to 15B show a method for pulling out the input-output terminals from the case of such a conventional isolator and a structure for mounting the isolator on a substrate of a communication apparatus or the like.

FIG. 13A is a perspective view of the isolator; FIG. 13B is a perspective view showing a state that the isolator is mounted on a printed circuit board of a communication apparatus. In this example, the input-output terminals of the isolator are respectively arranged on the substantially bottom surface of the isolator and the isolator is surface-mounted by soldering the input-output terminals of the isolator to connecting pads on the printed circuit board. A module circuit board 3 forming a circuit module is surface-mounted on the printed circuit board 2, and the circuit on the module circuit board 3 and the isolator are electrically connected together via an electrode pattern formed on the printed circuit board 2.

FIG. 14A is a side view of an isolator of another structure; FIG. 14B is a drawing showing a mounting structure thereof. In this example, input-output terminals are pulled out of intermediate portions of the part height of the isolator. As shown in FIG. 14B, when the bottom surface of the isolator body is a grounding conductor: the isolator body is fixed on an earth block (a common earth plate) with screws; the printed circuit board 2 having the same shaped-opening as the planar external shape of the isolator is arranged on the earth block; the isolator is fitted into the opening of the printed circuit board 2; the input-output terminals of the isolator are soldered to connecting pads on the printed circuit board 2.

FIG. 15A is a side view of still another isolator; FIG. 15B is a drawing showing a mounting structure thereof. This example is basically of the same structure as that shown in FIGS. 14A and 14B; however, input-output terminals are pulled out of the top surface of the isolator. This mounting structure may be adopted when the isolator thickness is relatively small.

By the way, in the conventional isolator and the mounting structure thereof shown in FIGS. 13A and 13B, the isolator and the preceding stage circuits are connected together via conductor patterns formed on the printed circuit board. Therefore, there have been the following problems.

1) The pattern for connecting the isolator and the preceding stage circuits together needs to be designed to have excellent matching for preventing a loss in signal delivery.

2) For the same reason, every time when changing any of the thickness and material of the printed circuit board, the shape of the conductor pattern, or the part arrangement of the isolator or the preceding stage circuit, as well as when changing electrical characteristics of the isolator or the preceding stage circuit, the patterns for connecting between the isolator and the preceding stage circuits have to be redesigned.

3) Even when the connecting pattern is designed to have most excellent matching, there will be certainly produced various kinds of losses such as losses due to radiation from the conductor pattern, dielectric losses of the printed circuit board, conductor losses of the conductor pattern, and losses due to reflection in an incomplete matching portion. Also, even when the above-mentioned design is completely performed, there are manufacturing scattered values of the connecting pattern in shape and size and the printed circuit board in thickness and permitivity, so that matching incompletion cannot be avoided due to the dispersion. Furthermore, when a dielectric material of the printed circuit board absorbs atmospheric moisture, dielectric losses in the connecting pattern may increase. Unnecessary radiation generated from the connecting pattern may also produce a malfunction by interference with other circuits on the printed circuit board. In particular, the place surely capable of producing the internal mutual interference is the pattern portion connecting between a heavy-duty isolator such as a signal transmission portion of radio-communication equipment such as a portable telephone and the preceding stage circuits, i.e., an electric power amplifier.

4) The connecting pattern is arranged on the printed circuit board between the isolator and the preceding stage circuit requiring an area for this position to occupy, so that the position becomes dead spots so as to have difficulty in miniaturizing the entire device.

In the isolator and the mounting structure thereof shown FIGS. 14A to 15B, there are the following problems other than the problems 1) to 4).

5) The printed circuit board is required to have the opening for fitting the isolator thereinto, so that unless the opening is simple shaped, a mold is needed causing increase in cost.

6) The earth block for connecting the grounding conductor on the bottom face of the isolator is needed on the bottom of the printed-circuit-board opening for fitting the isolator thereinto so as to have difficulty in miniaturization and reduction in weight of the entire apparatus such as a communication unit.

SUMMARY OF THE INVENTION

Accordingly, it is an object of the present invention to provide a nonreciprocal circuit device that solves various problems such as losses, unnecessary radiation, and the internal mutual interference, which are produced at a connecting point between the nonreciprocal circuit device and a circuit to be connected thereto, and also to provide a mounting structure of the nonreciprocal circuit device capable of promoting reduction in losses, size, and weight by facilitating matching with the circuit to be connected thereto.

A nonreciprocal circuit device according to the present invention comprises a case having a substantially rectangular parallelepiped shape, an input terminal group disposed in juxtaposition at a first height from a first side of a mounting surface of the case, and an output terminal group disposed in juxtaposition at a second height from a second side opposite to the first side of the mounting surface, wherein the first and the second height are different from each other. By this structure, the input terminal group or the output terminal group can be directly connected to connecting pads on a circuit board according to the height of the circuit board having circuits to be connected to the nonreciprocal circuit device.

The first height may be located at one of an intermediate height of the case and the top-face height of the case, and the second height may be substantially the same height as the bottom surface of the case. By this structure, the output terminal group is directly connected to a printed circuit board for mounting the nonreciprocal circuit device, and the input terminal group can be directly connected to connecting pads on the top surface of a module circuit board of preceding stage circuits to be mounted on the printed circuit board.

The height of the input terminal group may be determined by according to the thickness of the module circuit board forming the preceding stage circuits, so that the input terminal group of the nonreciprocal circuit device and the connecting pads of the module circuit board are of equal height in a state that the module circuit board and the nonreciprocal circuit device are mounted on the printed circuit board, thereby eliminating dead spots and reducing the thickness of the entire device.

The input and output terminal groups may include hot terminals and ground terminals, respectively. The width or thickness of at least one terminal of the input terminal group may be increased larger than that of any terminal of the output terminal group, so that the strength of the input terminal group located in a position separated from the top surface of the printed circuit board, and at which a stress is liable to concentrate, is increased, thereby the drop-proof strength of the communication unit can be improved.

The number of ground terminals of the input terminal group may be plural, so that the connecting strength of the input terminal group is increased and grounding connection is secured, thereby mismatching in impedance and unnecessary radiation can be securely prevented.

The input terminal group may be formed on the bottom surface of an insulator plate, so that the strength of the input terminal group and the drop-proof strength are improved.

The impedance of the input terminal group may be within the range of 3 Ω to 30 Ω. When a preceding stage circuit of the nonreciprocal circuit device is a power-amplifying circuit for transmitting signals, it may be intended to achieve the overall efficiency higher compared with the case where the impedance is 50 Ω by making the output impedance from 3 Ω to 30 Ω. Even when connecting to the preceding stage circuit with such low impedance, the impedance matching can be easily performed by directly connecting the input terminal group of the isolator adjusted to have the matching in advance to the preceding stage circuit without using a connecting pattern formed on the printed circuit board. When circuits both having the low impedance are connected together, losses due to the resistance in series of the connecting pattern and the wiring are increased; however, the losses are negligible when the impedance matching is performed without using the connecting pattern on the printed circuit board.

In the nonreciprocal circuit device according to the present invention, the input terminal group may be weldable to connecting pads on the module circuit board. When the nonreciprocal circuit device and the module circuit board are welded together in advance by welding the input terminal group of the nonreciprocal circuit device to the connecting pads on the module circuit board, the connecting strength between both members is increased, so that the connecting portion of both members can be prevented from breaking apart due to heat of reflowing solder when soldering to the printed circuit board.

The input terminal group may be made of Ni, or a Ni-alloy, for example. Thereby, the welding strength is further increased, so that laser output power required for laser welding or a welding current required for resistance welding is reduced, thereby reducing equipment cost and electricity consumption during manufacturing.

In the nonreciprocal circuit device according to the present invention, a film made of Sn, a Sn-alloy, or solder may be formed on the input terminal group. Thereby, solderability and the connecting strength during soldering are improved. When flux is coated thereon, the connection to the module circuit board can be performed only by re-melting of the film, i.e., without solder-coating again.

In the nonreciprocal circuit device according to the present invention, a metallic member forming a case of the nonreciprocal circuit device or the ground terminals integrated with the metallic member may be connected to a shield member on the module circuit board for connecting to the input terminal group or the output terminal group. By this structure, the connecting strength between the nonreciprocal circuit device and the module circuit board is further improved. When both the members in a state connected together are mounted on the printed circuit board, the strength before mounting on the printed circuit board can be sufficiently increased. Furthermore, the nonreciprocal circuit device becomes continuous with the shield member on the module circuit board, so that the entire shielding effect increases.

In the nonreciprocal circuit device according to the present invention, a metallic material forming the case or a part of the magnetic circuit integrated with the case may be connected to a ground portion on the module circuit board for connecting to the input terminal group or the output terminal group, and the metallic material is allowed to serve as the case in the module circuit board side or as the shield member. By this structure, the connecting portion between the case of the nonreciprocal circuit device and the case to be arranged in the module circuit board side is avoided to be a weak point in the mechanical strength, i.e., in the stiffness. Also, a problem can be solved, in which the connecting portion between both the cases has a large electrical resistance, i.e., unnecessary impedance in series, thereby deteriorating the stability in the earth potential, so that the operation of the nonreciprocal circuit device integrated with the module circuit board becomes unstable.

In a mounting structure of a nonreciprocal circuit device according to the present invention, a nonreciprocal circuit device having any one of structures described above and a module circuit board are mounted on predetermined positions on a printed circuit board, and the input terminal group of the nonreciprocal circuit device is connected to first connecting pads on the module circuit board while the output terminal group of the nonreciprocal circuit device is connected to second connecting pads on the printed circuit board.

DESCRIPTION OF THE PREFERRED EMBODIMENTS

An isolator and a mounting structure thereof according to a first embodiment will be described with reference to FIGS. 1A to 5B.

Figure 1A:
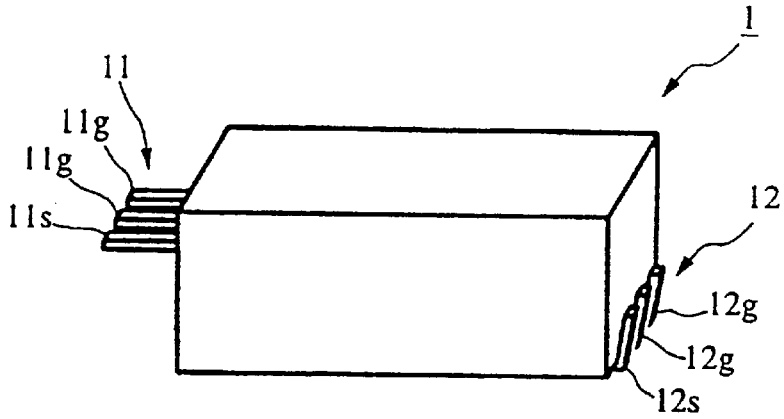
FIGS. 1A and 1B are perspective views of an isolator and a mounting structure thereof according to a first embodiment.
Figure 1B:
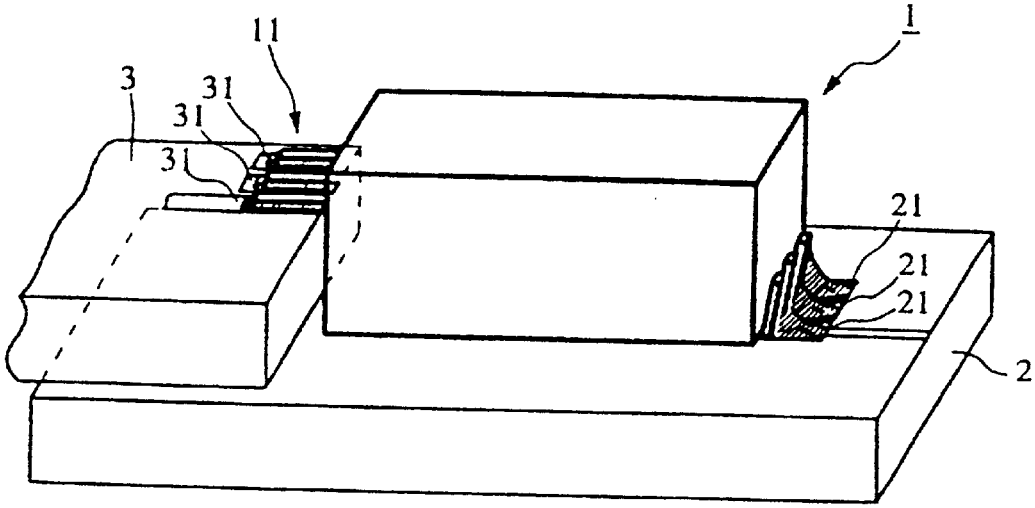

FIG. 1A is a perspective view of an isolator; FIG. 1B is a perspective view of the isolator in a mounted state. The bottom face of an isolator 1 viewed in the drawing is a mounting surface; input terminals 11 are disposed in juxtaposition at a predetermined height from a first side of the mounting surface; output terminals 12 are disposed in juxtaposition at a second side of the mounting surface opposing the first side. The input terminals 11 are formed of one hot terminal 11*s* and two ground terminals 11*g*; the output terminals 12 are formed of one hot terminal 12*s* and two ground terminals 12*g*.

In FIG. 1B, a module circuit board 3 and the isolator 1 are mounted on the top surface of a printed circuit board 2 forming the most part of circuits of a communication unit. On the module circuit board 3, a power amplifier for electrically amplifying a sending signal is mounted, for example, and connecting pads 31 are formed on the top face of the module circuit board 3. The input terminals 11 of the isolator 1 are soldered to respective connecting pads 31 on the module circuit board 3; the output terminals 12 of the isolator 1 are soldered to respective connecting pads 21 on the printed circuit board 2.

Figure 2A:
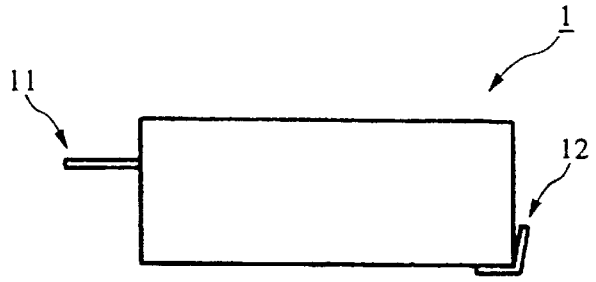
FIGS. 2A and 2B are front views showing the isolator and the mounting structure thereof.
Figure 2B:
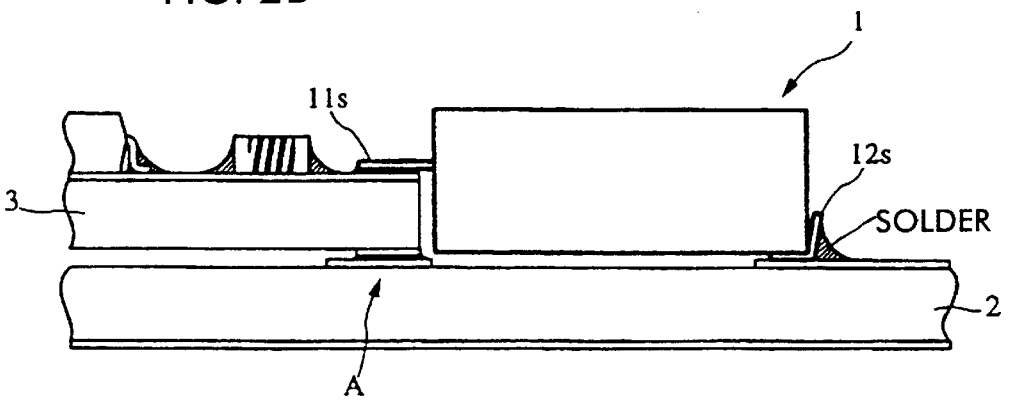

FIG. 2A is a side view of the isolator 1; FIG. 2B is a side view of the isolator 1 in a mounted state. The input terminals 11 extend from the case of the isolator 1 in the direction parallel to the mounting surface; the output terminals 12 protrude along the mounting surface (bottom surface) and is bent along the side of the case.

The input terminals 11 and the output terminals 12 are formed by integrating a stamped plate of Ni or a Ni alloy into a resin case by insert-molding. Also, on surfaces of the input terminals 11 and the output terminals 12, films of Sn, a Sn alloy, or solder are formed.

The purposes for using an isolator are as follows: 1) to stabilize the operation of the power amplifier; 2) to operate the power amplifier at a high-efficient operating point; those are, to appropriately match load impedances with the power amplifier and to prevent fluctuation in impedances due to changes in external circumstances; 3) to prevent the mutual modulation distortion of the power amplifier from being produced due to a counter flow of an external signal via an antenna; 4) to protect the power amplifier from the reflected electric power; and so forth.

The module circuit board 3 is a board for forming the preceding-stage circuits of the isolator 1 as an integrated module, and a several-stepped power amplifier is built-in as one body so as to form an electric-power-amplifying circuit. The board portion of the module circuit board 3 is made of a material such as a glass/epoxy substrate, a ceramic substrate, or a fluorinated resin/glass substrate, and is formed to be a substrate having copper linings formed on both surfaces or to be a multi-layer substrate. The top surface of the module circuit board 3 is used for mounting parts such as semiconductor elements, capacitors, resistors, and coils, and is also used for forming a circuit element such as a microstrip line. On the other hand, the bottom surface of the module circuit board 3 is provided with a connecting-terminal electrode for mounting the module circuit board 3 by soldering on the printed circuit board of the communicating unit. This connecting-terminal electrode may be formed to have an L-shaped cross-section so as to expand not only on the bottom surface of the module circuit board 3 but also to expand onto the side face (end face) thereof.

In order to prevent interference from other circuits when integrating a number of circuit elements simultaneously, the module circuit board is provided with a shield case covering the top thereof and being grounded. By forming the preceding-stage circuit section of the isolator in an integrated module in such a manner, the occupying area of the circuit section is reduced relative to the printed circuit board so as to stabilize the operation and to furthermore facilitate the design of the communication unit.

On the other hand, the printed circuit board 2 is used for unifying principal parts necessary for the operation of the communication unit by combining a transmitting section, a receiving section, a signal-processing section, a controlling section, etc., of the communication unit, so that all the parts mountable on the printed circuit board 2 are equipped on the printed circuit board 2.

When mounting the isolator 1: first, the connecting pads on the top surface of the module circuit board 3 are soldered to the input terminals 11 so as to unify the both; when using the film of Sn, a Sn alloy, or solder formed on the input terminals for connecting, the soldering can be performed without supplying solder; then, parts for unifying the isolator 1 and the module circuit board 3 are soldered at predetermined positions of the printed circuit board 2 by reflowing; the connecting pads formed on the bottom surface of the module circuit board 3 are thereby connected to the predetermined connecting pads on the top surface of the printed circuit board 2 while the output terminals 12 of the isolator 1 are simultaneously connected to the predetermined connecting pads on the printed circuit board 2.

Instead of soldering, connection may be performed by laser welding or resistance welding. The input terminals made of Ni or a Ni alloy facilitate welding and enables the connecting strength to be increased. In this case, the film of Sn, etc., on the surface is not required.

Figure 3:
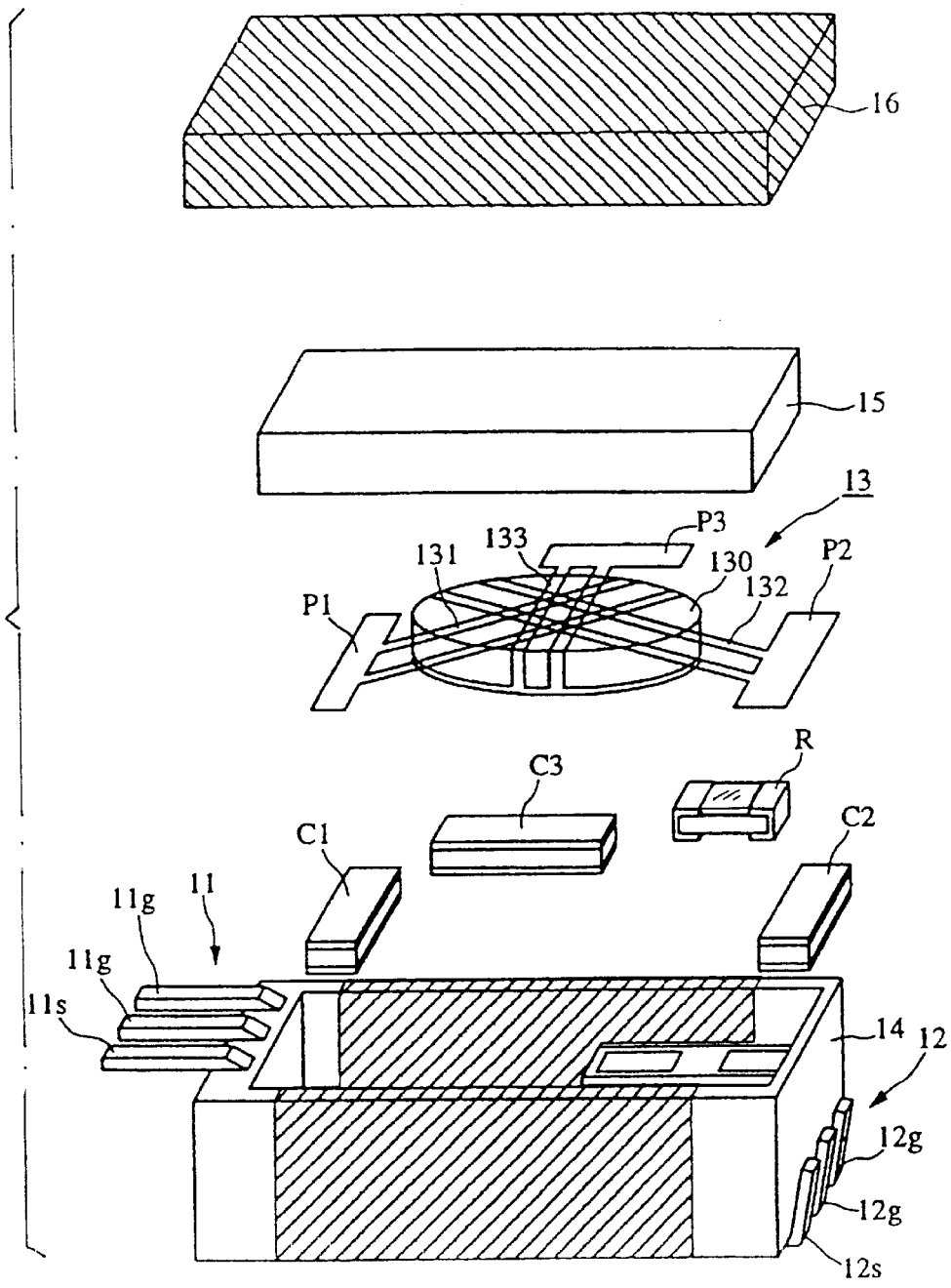
FIG. 3 is an assembly view of the isolator.

FIG. 3 is an assembly view of the isolator showing the internal structure; FIG. 4 is a top plan view thereof showing the internal structure.

In both the drawings, a ferrite assembly 13 comprises a circular-disc-like ferrite 130 placed on a circular placing section and three central conductors 131, 132, and 133 extending from the placing section radially at intervals of approximately 120° so as to be bent for wrapping the ferrite 130. The respective tip ends of the central conductors 131, 132, and 133 are ports P1, P2, and P3. A permanent magnet 15 applies a static magnetic field to the ferrite 130 in the vertical direction. A yoke 16 forms a magnetic path together with a yoke (indicated by hatching in the drawing) formed in a resin case 14 by integration molding. Capacitors C1, C2, and C3 and a resistor R are connected to the ports P1, P2, and P3 of the central conductors, respectively. The input terminals 11 and the output terminals 12, etc., are insert-molded into the resin case 14. The isolator 1 is assembled as follows: the capacitors C1, C2, and C3 and the resistor R are accommodated within the resin case 14; furthermore, the ferrite assembly 13 is accommodated therein; the yoke 16 is attached to the resin case 14 in a state that the magnet 15 is attached to an internal surface of the yoke 16.

Figure 4A:
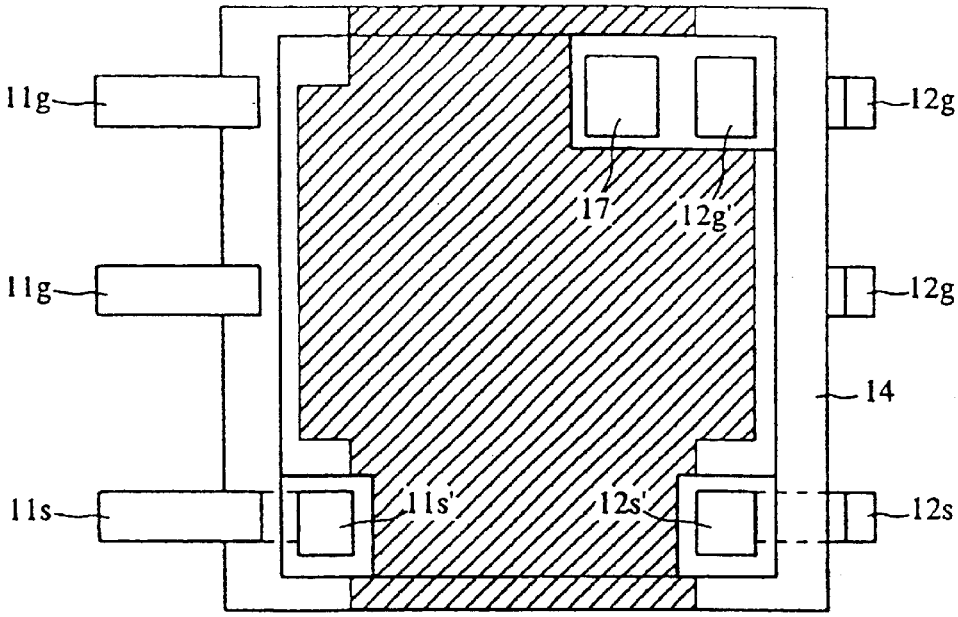
FIGS. 4A and 4B are top plan views showing the internal structure of the isolator.
Figure 4B:
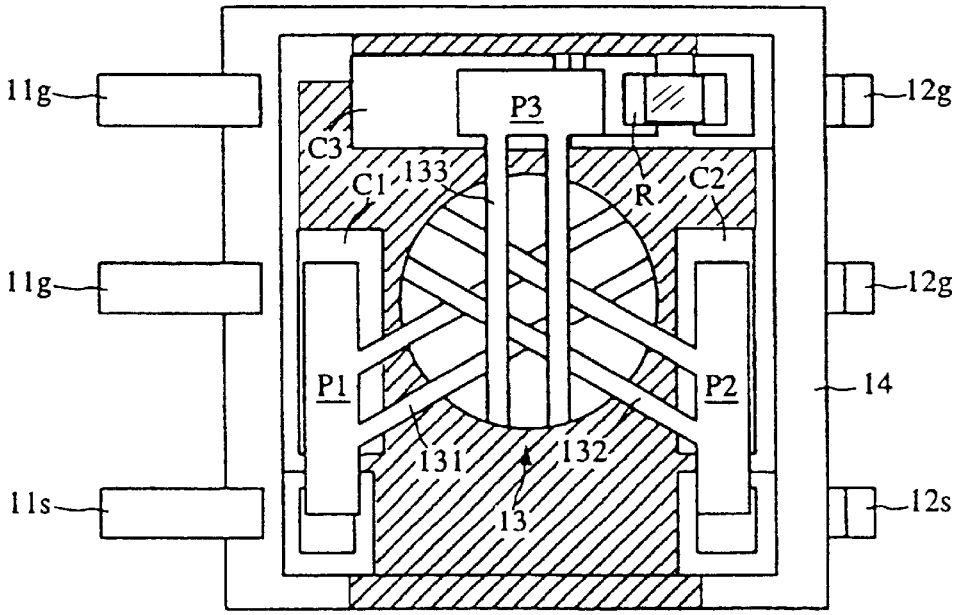

FIG. 4A is a top plan view of the resin case 14; FIG. 4B is a top plan view of the resin case 14 in a state that the capacitors C1, C2, and C3, the resistor R, and the ferrite assembly 13 are accommodated therein.

On the internal bottom surface of the resin case 14, the respective internal ends of terminals 11*s*, 12*s*, and 12*g* are formed therein as connecting pads 11*s*', 12*s*', and 12*g*', respectively, and furthermore, an electrode 17 is formed independently of these connecting pads. As shown in FIGS. 4A and 4B, the port P1 is connected to a top-face electrode of the capacitor C1 and the connecting pad 11*s*'; the port P2 is connected to a top-face electrode of the capacitor C2 and the connecting pad 12*s*'; the port P3 is connected to a top face electrode of the capacitor C3 and the electrode 17; the resistor R is connected to a point between the electrode 17 and the connecting pad 12*g*'.

In addition, in this example, the ferrite 130 is circular disc-shaped; however, the shape is not limited to this and may be rectangular solid or polygonal plate-shaped.

Figure 5A:
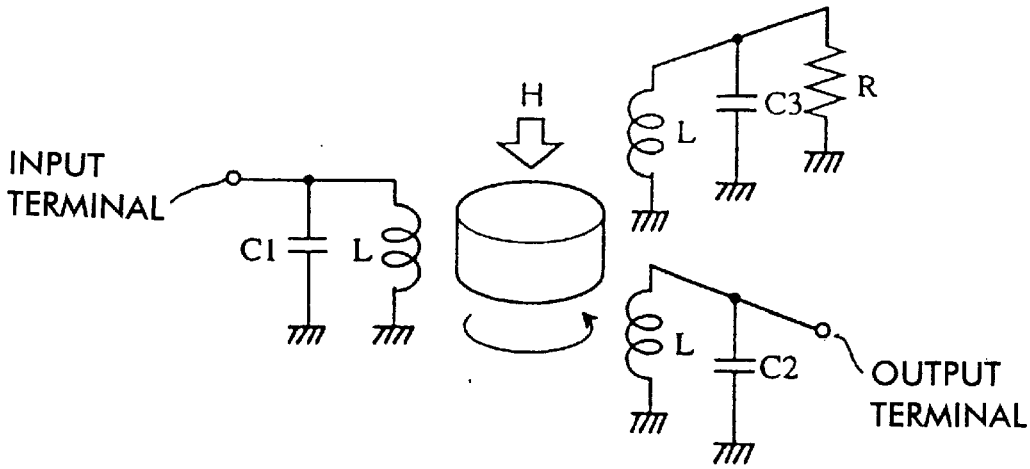
FIGS. 5A and 5B are equivalent circuit diagrams of the isolator.
Figure 5B:
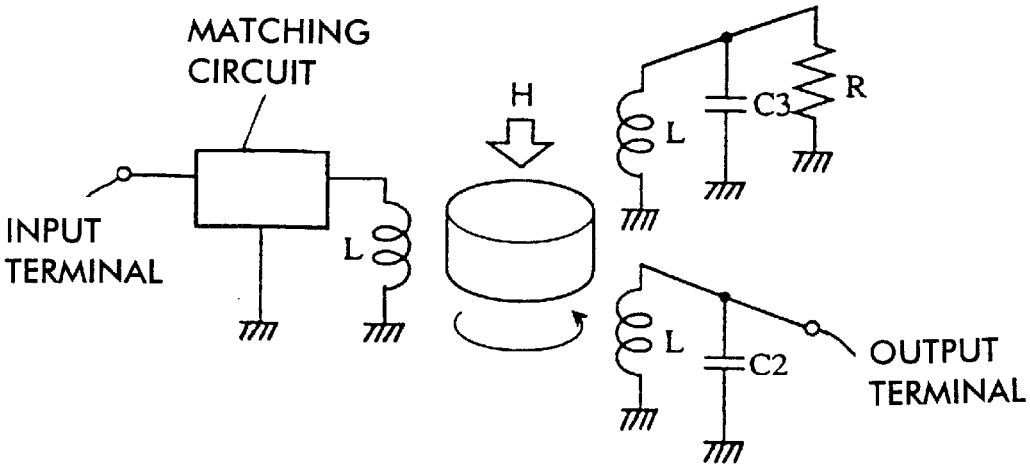

FIGS. 5A and 5B are equivalent circuit diagrams of the isolator; FIG. 5A is an equivalent circuit diagram of an ordinary isolator with an input-impedance of 50 Ω wherein the capacitors C1, C2, and C3 are capacitors for matching an inductance L of the central conductor, and a resistor R functions as a terminating resistor. By this structure, an isolator is formed, in which one port of a three-port type circulator is resistance-terminated.

FIG. 5B is an equivalent circuit diagram of a non-50 Ω-isolator with an input-impedance in the range of 3 Ω to 30 Ω, preferably 10 Ω to 20 Ω wherein a matching circuit matches the impedance of the non-50 Ω-isolator with the impedance of the 50 Ω isolator. When an isolator with low input-impedance is used in such a manner, the isolator can be directly connected to the preceding stage circuit with low output impedance. The reasons of the input-impedance of the isolator for being in the range of 3 Ω to 30 Ω are as follows.

In a mobile-radio-communication unit such as a portable telephone having a battery as a power source with a low voltage of approximately 3 V, the output-impedance of a bipolar transistor of the power amplifier or a FET is generally in the range of 3 Ω to 5 Ω, approximately. In order to directly connect such a power amplifier with low output-impedance to the isolator, the input-impedance of the isolator may be from 3 Ω to 5 Ω. When the isolator is directly connected to the power amplifier without the matching circuit provided in the power amplifying circuit at this time, the efficiency can be improved as much as the matching circuit is eliminated.

On the other hand, when the matching circuit is built-in the power amplifying circuit, there are advantageous effects such as reduction in higher harmonic components. At this time, the output-impedance of the bipolar transistor or the FET is approximately in the range of 10 Ω to 20 Ω, so that signals are exchanged between the isolator and the power amplifying circuit at impedances of from 10 Ω to 20 Ω.

When a two-stepped matching circuit is provided in the power amplifying circuit, higher harmonic components can be furthermore reduced. At this time, the output-impedance of the first step of the matching circuit is 15 Ω and the output-impedance of the second step is the range of 20 Ω to 30 Ω, so that signals are exchanged between the isolator and the power amplifying circuit at impedances of 20 Ω to 30 Ω.

When the matching circuit is provided with more than tow steps, losses are disadvantageously increased. The harmonic suppressing effect can be sufficiently obtained by the two-stepped matching circuit. Accordingly, it is advantageous for achieving high efficiency to have an input-impedance of the isolator in the range of 3 Ω to 30 Ω.

As described above, by directly connecting the module of the preceding-stage circuit of the isolator with the isolator not through the conductor pattern on the printed circuit board, the following advantageous effects are achieved.

1) It is not required to design configurations connecting between the isolator and the preceding-stage circuit thereof.
2) When any one of amendments is made in the thickness, material, and conductor pattern shape of the printed circuit board, and in part arrangements of the isolator and the preceding-stage circuit, as well as when changing electrical characteristics of the isolator and the preceding-stage circuit, the printed circuit board is not required any changes and designs about the matching the isolator with the preceding-stage circuits as long as the isolator matches with the preceding-stage circuits.
3) Since the isolator is directly connected to the preceding-stage circuits and the connecting portions are not taken outside, unnecessary losses and internal interference are not produced.
4) Since the conductor pattern for connecting the isolator to the preceding-stage circuits is not formed on the printed circuit board, the printing can be reduced as much as the conductor pattern enabling the entire device to be miniaturized.
5) Any specific work such as perforating the printed circuit board for mounting the isolator is not necessary and the isolator and the preceding-stage circuits are mounted on the printed circuit board in a state that the both are connected together in advance, so that the cost in mounting can be furthermore reduced. Troubles due to deficiencies in mounting can also be avoided thereby improving the yield rate and reliability.
6) Any member such as the earth block for connecting grounding conductors on the bottom of the isolator is not also necessary, so that a compact and light-weight device can be constructed in low cost.

Figure 6A:
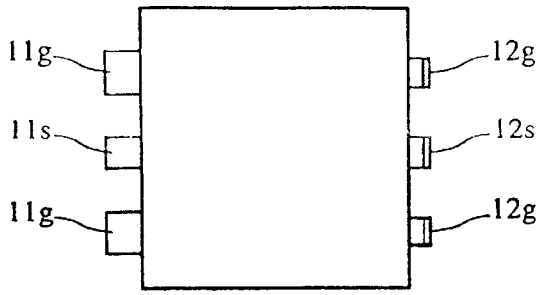
FIGS. 6A to 6C are top plan views and a front view of an isolator according to a second embodiment.
Figure 6B:
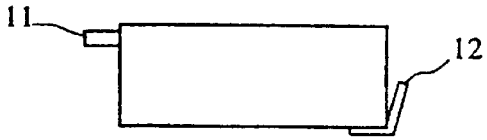
Figure 6C:
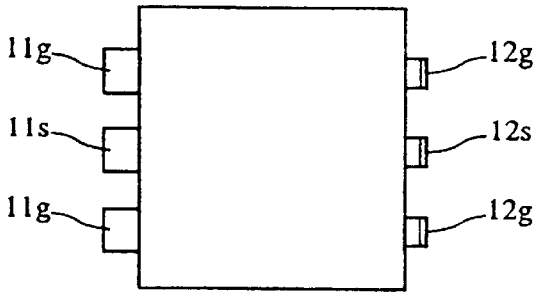

FIGS. 6A and 6B are drawings showing the structure of an isolator according to a second embodiment; FIG. 6A is a top plan view thereof; FIG. 6B is a front view thereof. In this embodiment, the width of the ground terminal 11*g* of the input terminals is larger than that of the ground terminal 12*g* or the hot terminal 12*s* of the output terminals. FIG. 6C is a top plan view of another isolator; in this example, the widths of not only the ground terminal 11*g* of the input terminals but also of the hot terminal 11*s* are lager than that of the ground terminal 12*g* or the hot terminal 12*s* of the output terminals.

By these structures, as shown in FIGS. 1A and 1B, in a state that the input terminals 11 of the isolator are connected to the module circuit board 3, that is, in a state before being mounted on the printed circuit board, the connecting strength between the both can be increased.

In addition, because of the structure that the input terminals are connected to the connecting pads on the module circuit board at a position higher than the top surface of the printed circuit board in a state that the isolator and the module circuit board are mounted on the printed circuit board, the input terminals are liable to be concentrated by a stress more than the output terminals. However, by increasing the connecting strength of the input terminals by the structure shown in FIGS. 6A to 6C, the drop-proof strength of the communication unit can be improved.

By providing plural ground terminals 11*g* of the input side in such a manner, the connecting strength of the isolator to the connecting pads on the module circuit board is increased while the earth connection is secured.

In the structures shown in FIGS. 1A to 2B, the module circuit board 3 interposes between the ground terminals 11*g* of the isolator 1 and the earth surface of the printed circuit board 2; when the earth in the input of the isolator is not zero-potential due to the impedance in series in the module circuit board 3, the operation becomes unstable deteriorating characteristics of the isolator 1. However, as shown in FIG. 6A, by increasing the widths of the ground terminals of the input, the impedance in series is reduced so that the deficiencies can be reduced to be a small matter level. As shown in FIG. 6B, by increasing also the width of the hot terminal 11*s*, the losses especially when a signal is received in low impedances of from 3 Ω to 30 Ω can be furthermore reduced.

Furthermore, in the examples shown in FIGS. 6A to 6C, by arranging the ground terminals 11*g* in both sides of the hot terminal 11*s* of the input terminals, the shielding of an input signal is improved and the unnecessary radiation can be more restrained. This is the same with terminals in the output side.

Figure 7A:
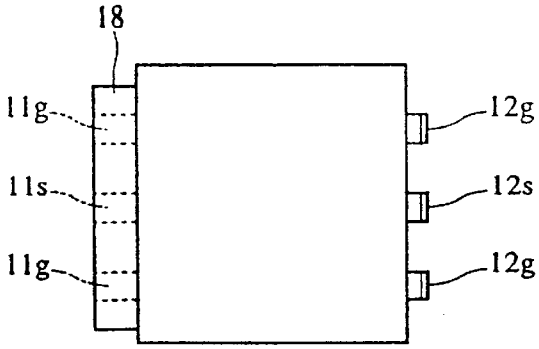
FIGS. 7A and 7B are a top plan view and a front view of an isolator according to a third embodiment, respectively.
Figure 7B:
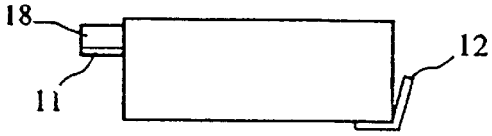

FIGS. 7A and 7B are drawings showing the structure of an isolator according to a third embodiment; FIG. 7A is a top plan view thereof; FIG. 7B is a front view thereof; an insulator 18 protrudes from a side of the isolator in a plate shape and the input terminals 11 are arranged on the bottom face of the insulator 18. The insulator 18 may be part of the resin case 14 shown in FIG. 3, etc., or may be independent from the resin case 14. The input terminals 11 may be integrated with the bottom face of the insulator 18 by insert-molding. Furthermore, the input terminals 11 may be formed on the bottom face of the insulator 18 by pattern forming of a conductor film. By any of these structures, the insulator 18 increases the strength of the input terminals and the connecting strength to the module circuit board, thereby increasing the drop-proof strength of the communication unit in a state that the both are mounted on the printed circuit board.

Next, an isolator and a mounting structure thereof according to a fourth embodiment will be described with reference to FIGS. 8 and 9.

Figure 8:
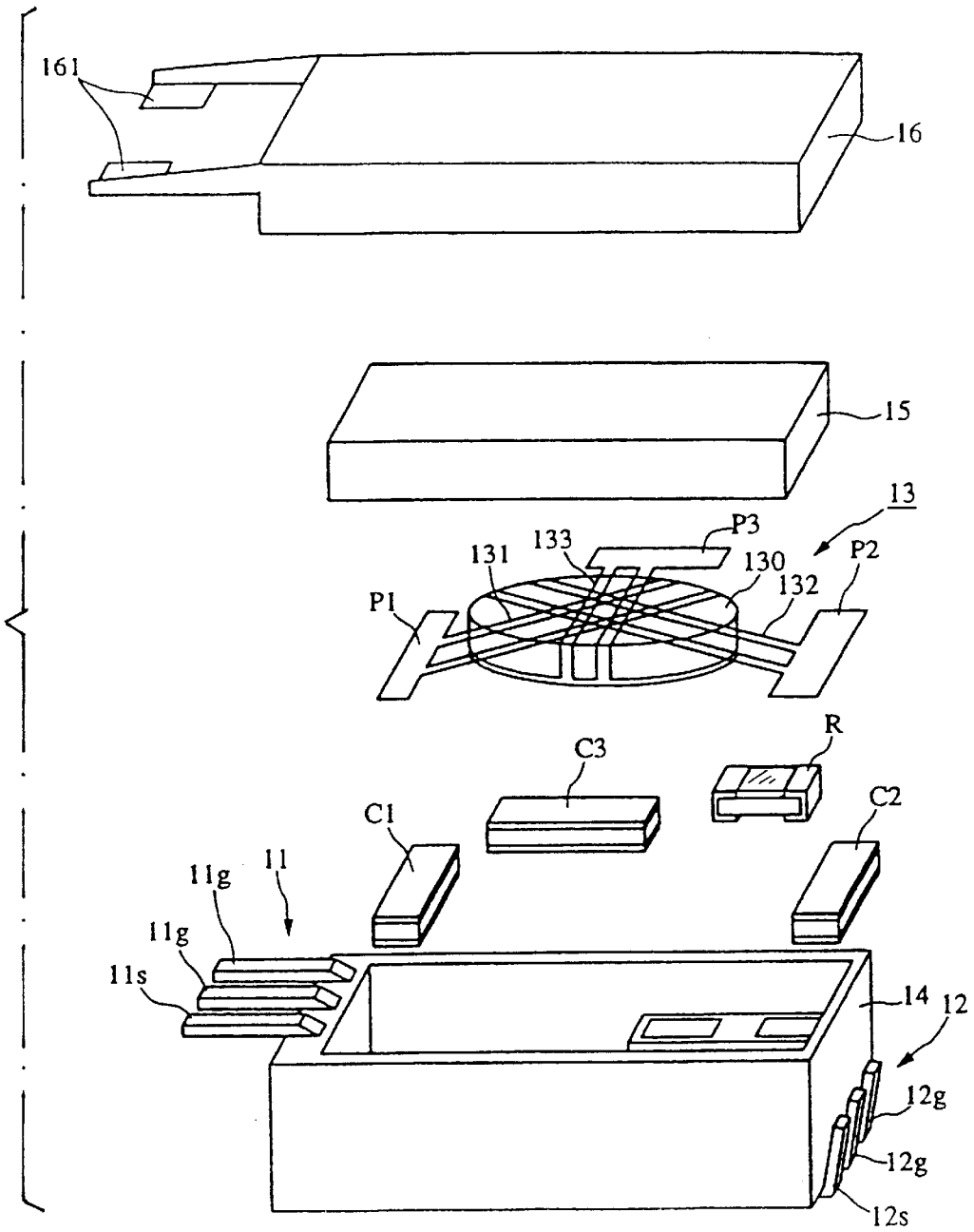
FIG. 8 is an assembly view of an isolator according to a fourth embodiment.

FIG. 8 is an assembly view of the isolator; FIG. 9 is a perspective view thereof in a mounted state. Different from the isolator shown in FIG. 3, part of the yoke 16 protrudes sideways as ground terminals 161. Other parts are the same as those shown in FIG. 3.

Figure 9:
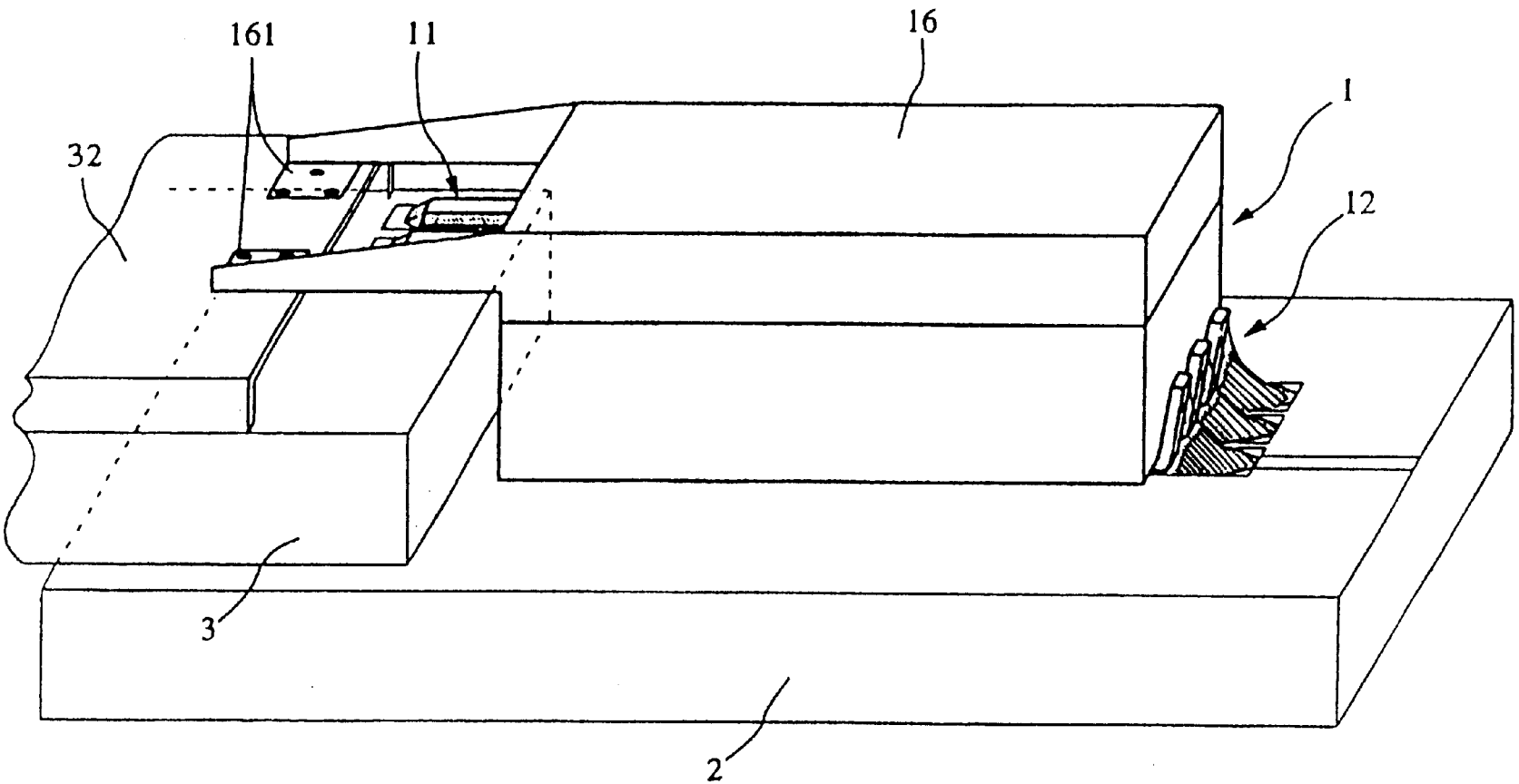
FIG. 9 is a perspective view showing a mounting structure of the isolator according to the fourth embodiment.

In FIG. 9, a shield case 32 is attached on the top surface of the module circuit board 3 and the ground terminals 161 extending from the yoke 16 are electrically and mechanically connected to the shield case 32 in the module circuit board side. The manners for connecting the input terminals to connecting pads on the top surface of the module circuit board and for connecting the output terminals to connecting pads on the top surface of the printed circuit board are the same as those shown in FIGS. 1A and 1B. By such a structure, the connecting strength between the isolator and the module circuit board 3 having the shield case 32 formed thereon is largely increased, so that sufficient strength can be secured even in a state before the both are mounted on the printed circuit board 2. After the both are simultaneously mounted on the printed circuit board 2, the connecting strength to the printed circuit board 2 is sufficiently secured enabling the drop-proof strength of the communication unit to be improved. Also by this structure, the shield member in the module circuit board side is continuous with the shield member in the isolator side so as to improve the entire shielding benefit.

In addition, in the embodiments described above, the input terminals comprise one hot terminal and plural ground terminals and these terminals are connected to connecting pads on the top surface of the module circuit board; however, at least the hot terminal may be connected on the top surface of the module circuit board and the ground terminals of the input terminals may be arranged on the mounting surface (bottom surface) of the isolator case so as to be connected and grounded to the connecting pads on the printed circuit board.

Next, an isolator and a mounting structure thereof according to a fifth embodiment will be described with reference to FIG. 10.

Figure 10:
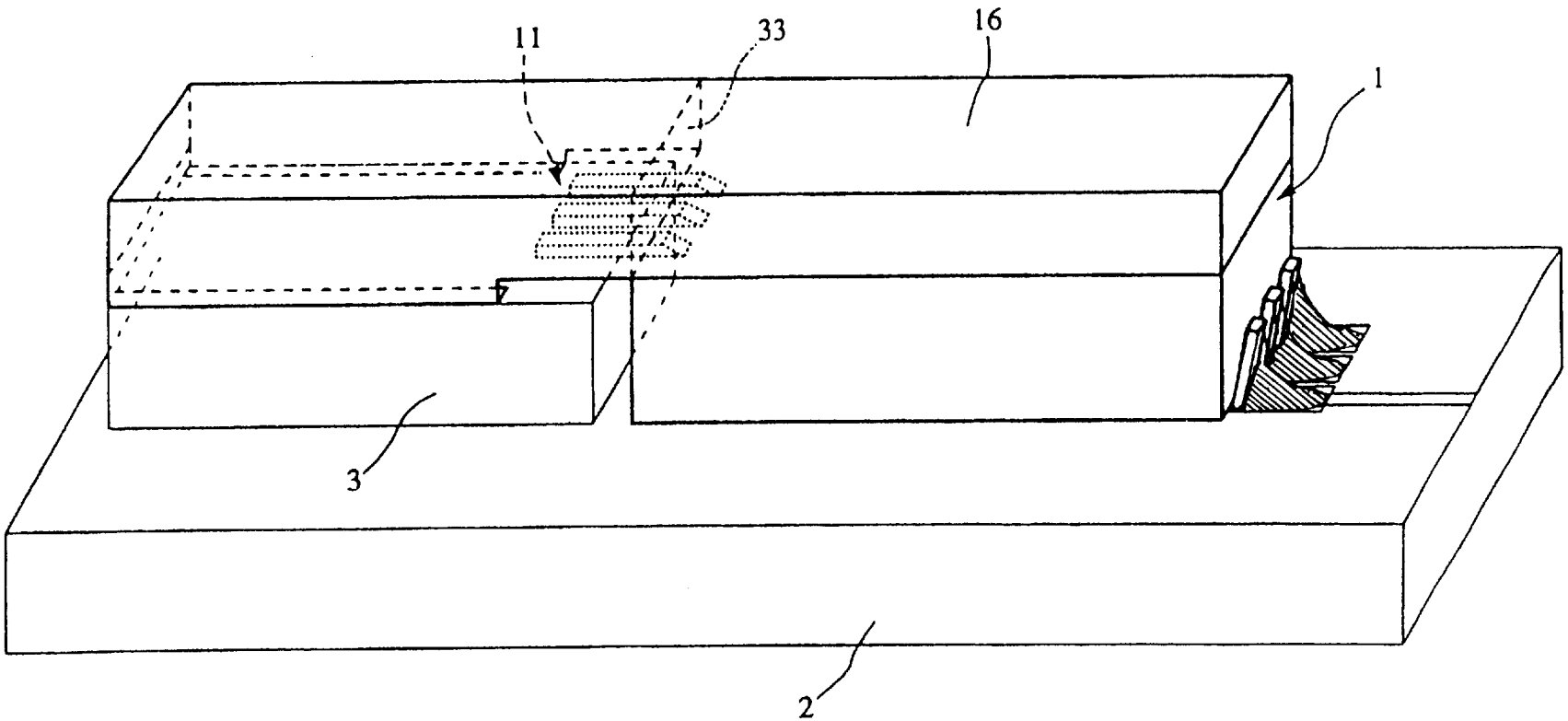
FIG. 10 is a perspective view of an integrated part between an isolator according to a fifth embodiment and a module circuit board in a mounted state.

FIG. 10 is a perspective view of parts in which the isolator is integrated with the module circuit board in a mounted state. Different from the isolator shown in FIG. 9, the yoke 16 serving both as the shield case and the case of the isolator is formed to have a size covering the principal part of the module circuit board 3, and the part of the yoke 16 covering the principal part of the module circuit board 3 is connected to a grounding section on the top surface of the module circuit board 3.

The grounding section on the top surface of the module circuit board 3 is provided with a connecting section so as to enable the part of the yoke 16 of the isolator to be connected thereto by welding or soldering. This structure facilitates the connection and integration of the both parts.

A shielding wall 33 is provided between the isolator and the module circuit board. The shielding wall 33 makes the shielding between the both parts perfect and stabilizes the operation of the integrated parts, and furthermore reduces an unnecessary harmonic such as the second harmonic wave and the third harmonic wave from escaping to the isolator and the succeeding stage circuits such as an antenna switch or a common using portion of an antenna.

The module circuit board 3 forms the power amplifying circuit thereon, and by connecting between connecting pads thereof and the input terminals 11 of the isolator together, the power amplifying circuit is integrated with the isolator.

The cases of the isolator and in the module circuit board side are integrated, so that sufficient strength can be secured even in a state before being mounted on the printed circuit board 2. After mounting on the printed circuit board 2, benefits such as improvements in the drop-proof strength, shielding capability, and operational stability can be obtained. Reduction in the entire number of connecting portions improves the yield rate in manufacturing and reduction in the number of parts reduces the cost and the number of breakdown factors while improving reliability.

Next, the structure of a communication apparatus will be described with reference to FIGS. 11 and 12.

Figure 11:
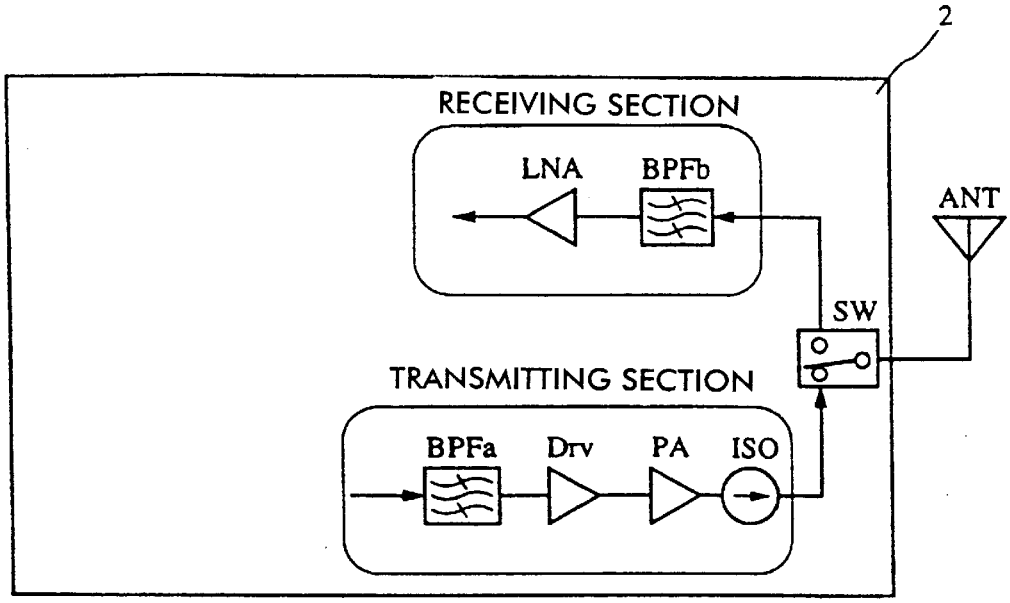
FIG. 11 is a block diagram of a communication apparatus.

FIG. 11 is a block diagram of a high-frequency circuit section of a communication apparatus. A band-pass filter BPFa passes only a transmitting-frequency band; Drv denotes an excitation amplifier; PA denotes a power amplifier; ISO represents an isolator. An antenna switch SW switches a transmitting signal and a receiving signal according to transmitting and receiving timing; ANT represents an antenna. A band-pass filter BPFb passes only a signal of a receiving frequency band; a low-noise amplifier LNA amplifies a receiving signal.

A transmitting signal passes through the band-pass filter BPFa, and is excited by the excitation amplifier Drv, is power-amplified by the power amplifier PA, and then passes through the isolator ISO, and is further radiated from the antenna ATN via the antenna switch SW. A signal in a receiving frequency band is selected in the band-pass filter BPFb from a receiving signal of the antenna ATN via the antenna switch SW, and is amplified in the low-noise amplifier LNA so as to be sent to a receiving section.

The isolator ISO uses the isolator described above and the power amplifier PA is formed on the module circuit board described above.

Figure 12:
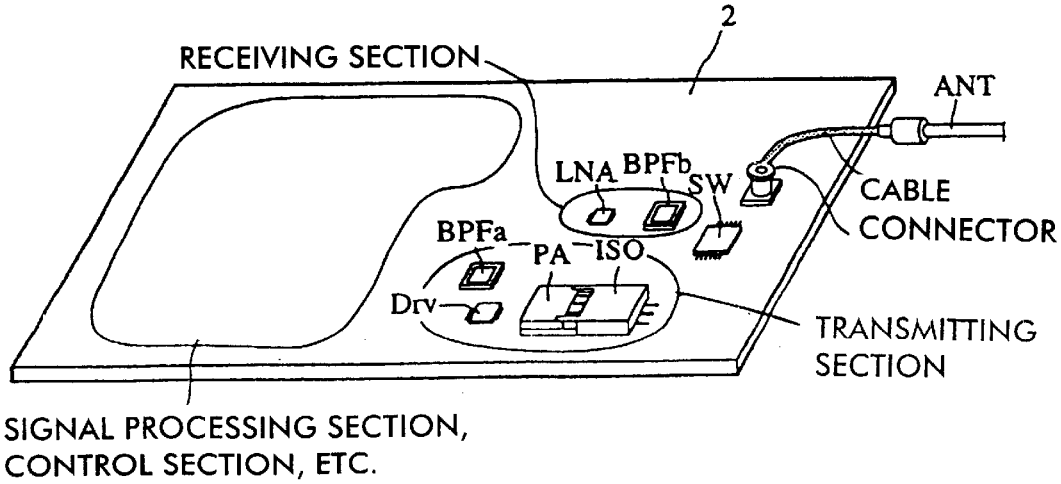
FIG. 12 is a perspective view of a principal part of the communication apparatus.
Figure 13A:
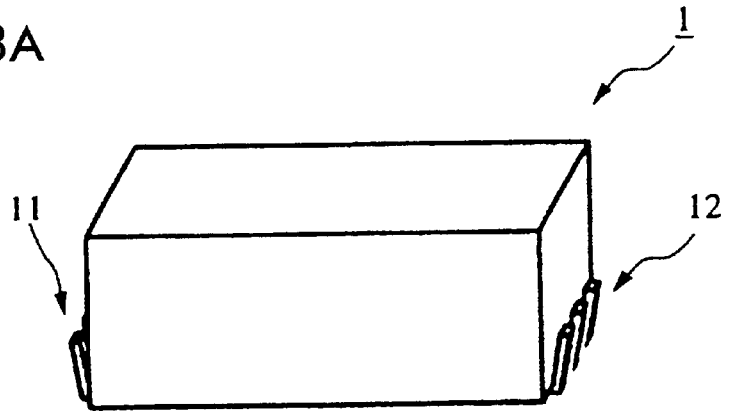
FIGS. 13A and 13B are perspective views of a conventional isolator and a mounting structure thereof, respectively.
Figure 13B:
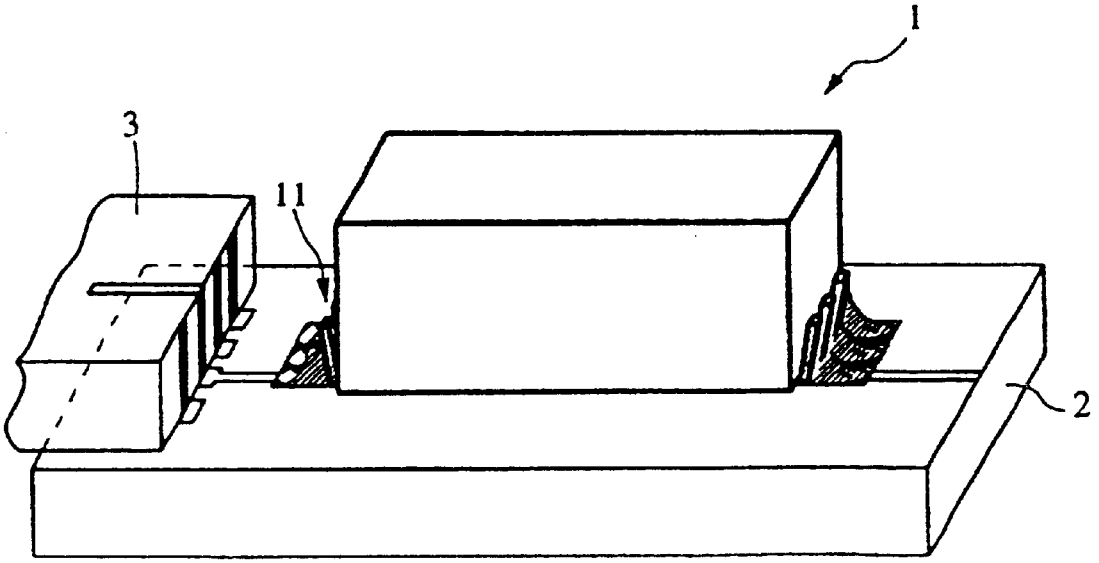
Figure 14A:
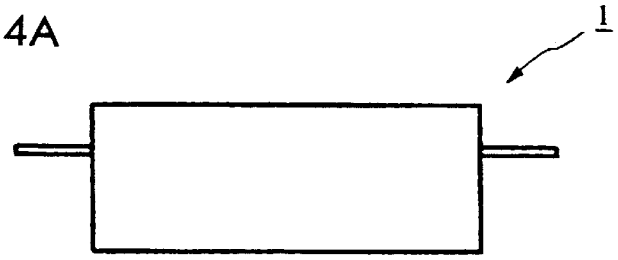
FIGS. 14A and 14B are perspective views of another conventional isolator and a mounting structure thereof, respectively.
Figure 14B:
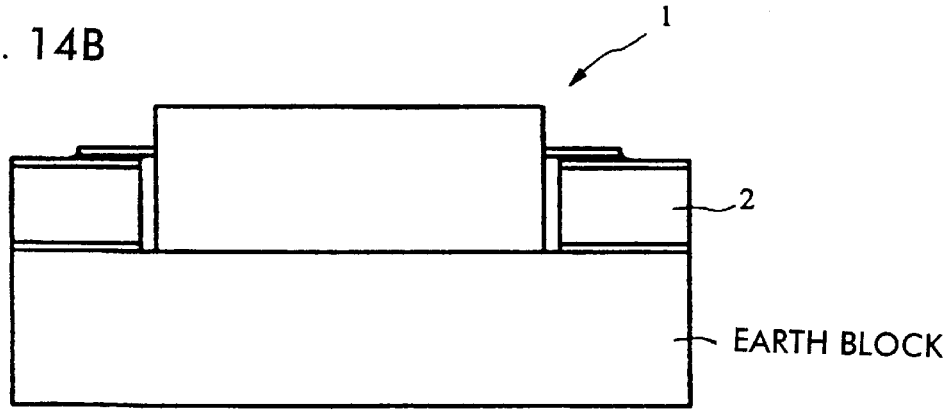
Figure 15A:
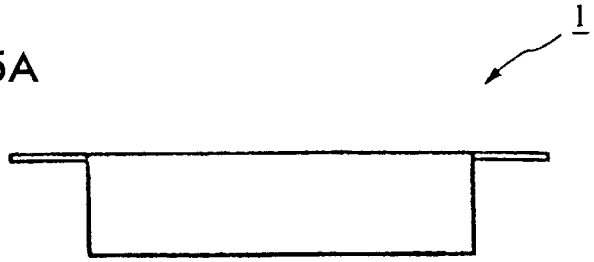
FIGS. 15A and 15B are perspective views of still another conventional isolator and a mounting structure thereof, respectively.
Figure 15B:
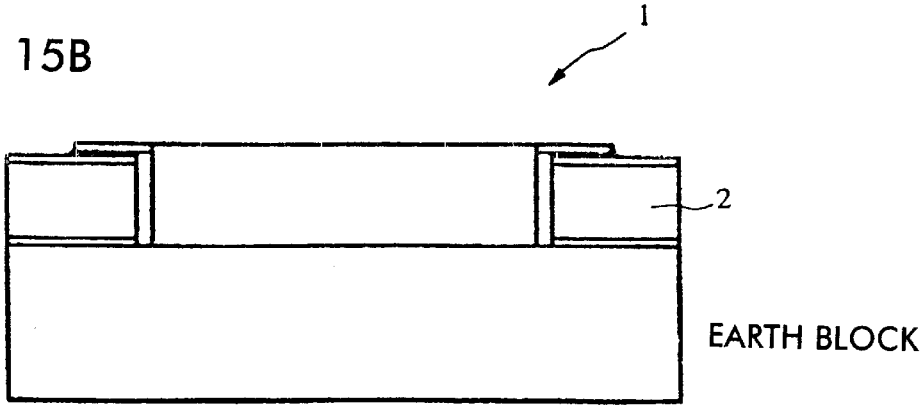

FIG. 12 is a perspective view of a principal part of a communication apparatus using the isolator according to the present invention. On the printed circuit board 2, a part in which the power amplifier PA is integrated with the isolator ISO is mounted. Similarly, the band-pass filter BPFa, the excitation amplifier Drv, the antenna switch SW, the band-pass filter BPFb, and the low-noise amplifier LNA are mounted thereon, respectively. A female coaxial-connector is attached to the printed circuit board 2 so as to be connected to a male coaxial-connector disposed at the tip end of a coaxial cable of the antenna ANT. The integrated part between the power amplifier PA and the isolator ISO has a structure shown in FIGS. 1A, 1B, 9, or 10.

On the printed circuit board 2, in addition to these parts, circuits such as a signal processing section for outputting a transmitting signal to a transmitting section and for inputting a receiving signal from a receiving section and a controlling section are mounted, and furthermore this printed circuit board 2 is accommodated within the case together with a microphone, a speaker, and buttons, so that a mobile-communication apparatus such as a portable telephone is constructed by furthermore attaching a battery thereto.

What is claimed is:

1. A nonreciprocal circuit device comprising:

a case having a substantially rectangular parallelepiped shape;

an input terminal group disposed in juxtaposition at a first height from a first side of a mounting surface of the case; and an output terminal group disposed in juxtaposition at a second height from a second side opposite to the first side of the mounting surface of the case, wherein the first and second heights are different from each other; and one of a metallic material constituting the case and the ground terminals integrated with the metallic material is formed so as to be connectable to a shield member disposed on a module circuit board for connecting to either the input terminal group or the output terminal group.

2. A device according to claim 1, wherein the first height is located at one of an intermediate height of the case and the top-face height of the case, and the second height is substantially the same height as the bottom surface of the case.

3. A device according to claim 1, wherein the first height is substantially the same as the height of a module circuit board, the module circuit board having connecting pads formed thereon to which the input terminal group is connected and being mounted on a printed circuit board, the output terminal group being connected to the printed circuit board.

4. A device according to claim 1, wherein the input terminal group and the output terminal group include hot terminals and ground terminals, respectively, and either the width or the thickness of at least one terminal of the input terminal group is larger than that of any one terminal of the output terminal group.

5. A device according to claim 4, wherein the number of the ground terminals of the input terminal group is two or more.

6. A device according to claim 1, wherein the input terminal group is formed on the bottom surface of a plate-like insulator.

7. A device according to claim 1, wherein the impedance of the input terminal group ranges from 3 Ω to 30 Ω.

8. A device according to claim 1, wherein the input terminal group is weldable to the connecting pads on the module circuit board.

9. A device according to claim 1, wherein the input terminal group is made of one of Ni and a Ni alloy.

10. A device according to claim 1, wherein a film made of one of Sn, a Sn alloy, and solder is formed on the input terminal group.

11. A nonreciprocal circuit device comprising:

a case having a substantially rectangular parallelepiped shape;

an input terminal group disposed in juxtaposition at a first height from a first side of a mounting surface of the case;

an output terminal group disposed in juxtaposition at a second height from a second side opposite to the first side of the mounting surface of the case;

a magnetic circuit integrated with the case; and a shield member integrated with the case wherein the first and second heights are different from each other; and metallic material forming one of the case and a portion of the magnetic circuit is connected to a ground portion disposed on a module circuit board for connecting to one of the input terminal group and the output terminal group and the metallic material defines one of the case in the module circuit board side and the shield member.

12. A device according to claim 11, wherein the first height is located at one of an intermediate height of the case and the top-face height of the case, and the second height is substantially to same height as the bottom surface of the case.

13. A device according to claim 11, wherein the first height is substantially the same as the height of a module circuit board, the module circuit board having connecting pads formed thereon to which the input terminal group is connected and being mounted on a printed circuit board, the output terminal group being connected to the printed circuit board.

14. A device according to claim 11, wherein the input terminal group and the output terminal group include hot terminals and ground terminals, respectively, and either the width or the thickness of at least one terminal of the input terminal group is larger than that of any one terminal of the output terminal group.

15. A device according to claim 11, wherein the number of the ground terminals of the input terminal group is at least two.

16. A device according to claims 11, wherein the input terminal group is formed on the bottom surface of a plate-like insulator.

17. A device according to claim 11, wherein the impedance of the input terminal group ranges from 3 Ω to 30 Ω.

18. A device according to claim 11, wherein the input terminal group is weldable to connecting pads on a module circuit board.

19. A device according to claim 11, wherein the input terminal group is made of one of Ni and a Ni alloy.

20. A device according to claim 11, wherein a film is made of one of Sn, a Sn alloy, and solder is formed on the input terminal group.

21. A mounting structure of a nonreciprocal circuit device comprising:

a printed circuit board;

a module circuit board; and a nonreciprocal circuit device according to claim 11, wherein the module circuit board and the nonreciprocal circuit device are mounted at predetermined positions on the printed circuit board, and wherein the input terminal group of the nonreciprocal circuit device is connected to first connecting pads formed on the module circuit board while the output terminal group of the nonreciprocal circuit device is connected to second connecting pads formed on the printed circuit board.

22. A mounting structure of a nonreciprocal circuit device comprising:

a printed circuit board;

a module circuit board; and a nonreciprocal circuit device according to claim 1, wherein the module circuit board and the nonreciprocal circuit device are mounted at predetermined positions on the printed circuit board, and wherein the input terminal group of the nonreciprocal circuit device is connected to first connecting pads formed on the module circuit board while the output terminal group of the nonreciprocal circuit device is connected to second connecting pads formed on the printed circuit board.

* * * * *